US012729941B2

(12) United States Patent
Jones et al.

(10) Patent No.: US 12,729,941 B2
(45) Date of Patent: Sep. 8, 2026

(54) ARTILLERY ROUND WITH ROCKET MOTOR DELAY

(71) Applicants: Kenneth R. Jones, Wayne, NJ (US); Nicholas C. Korinis, II, Franklin Lakes, NJ (US); Stojan Kotefski, Wayne, NJ (US)

(72) Inventors: Kenneth R. Jones, Wayne, NJ (US); Nicholas C. Korinis, II, Franklin Lakes, NJ (US); Stojan Kotefski, Wayne, NJ (US)

(73) Assignee: Savit Corporation, Rockaway, NJ (US)

( * ) Notice: Subject to any disclaimer, the term of this patent is extended or adjusted under 35 U.S.C. 154(b) by 82 days.

(21) Appl. No.: 18/227,881

(22) Filed: Jul. 28, 2023

(65) Prior Publication Data

US 2025/0035419 A1 Jan. 30, 2025

(51) Int. Cl.
*F42C 15/40* (2006.01)

(52) U.S. Cl.
CPC ..... *F42C 15/40* (2013.01)

(58) Field of Classification Search
CPC ..... F42C 15/40
See application file for complete search history.

(56) References Cited

U.S. PATENT DOCUMENTS 3,153,520 A 10/1964 Morris
3,955,508 A 5/1976 Will et al.
4,013,012 A 3/1977 Giattino
4,089,268 A * 5/1978 Jaroska ..... F42C 15/40 102/221
4,096,802 A 6/1978 Waln
4,739,705 A 4/1988 Hudson et al.
5,153,370 A * 10/1992 Hardt ..... F42C 15/285 102/250
5,265,539 A * 11/1993 Kurschner ..... F42C 15/40 102/209
6,196,130 B1 * 3/2001 Crist ..... F42C 15/40 102/221
6,740,828 B1 * 5/2004 Dacal ..... H01H 35/34 200/83 J (Continued)

FOREIGN PATENT DOCUMENTS

CN 113607007 A 11/2021

OTHER PUBLICATIONS

155MM M549A1 HE-RAP High Explosive—Rocket Assisted Projectile, General Dynamics Ordance and Tactical Systems, www.gd-ots.com—Approved for public release Sep. 25, 1997.

*Primary Examiner* — Michelle Clement
(74) *Attorney, Agent, or Firm* — Patterson + Sheridan, LLP

(57) ABSTRACT

Rocket-assisted artillery rounds and methods for firing the same are described herein. In one example, a rocket-assisted artillery round includes a projectile body, rocket fuel disposed in the projectile body, an ignitor positioned to ignite the rocket fuel, and an ignition control system. The ignition control system includes a controller coupled to first and second sensors. The first sensor is configured to detect a first metric. The first metric is indicative of rotation of the projectile body. The second sensor is configured to detect a second metric. The second metric is indicative of setback of the projectile body. The controller is configured to output an activation signal to the ignitor based on the first metric and the second metric.

22 Claims, 10 Drawing Sheets

(56) References Cited

U.S. PATENT DOCUMENTS

| | | | | |
|---|---|---|---|---|
| 7,004,072 | B1 * | 2/2006 | Ceola | F42C 15/40 102/221 |
| 7,278,658 | B2 | 10/2007 | Boucher et al. | |
| 7,748,324 | B2 * | 7/2010 | Sutcliffe | F42C 11/065 102/276 |
| 7,918,419 | B2 * | 4/2011 | Rosenfield | F42C 11/065 244/150 |
| 8,286,554 | B2 * | 10/2012 | Rastegar | F42C 11/02 102/210 |
| 8,418,617 | B2 * | 4/2013 | Rastegar | F42C 15/24 102/253 |
| 8,601,949 | B2 * | 12/2013 | Rastegar | F42C 11/008 102/209 |
| 8,677,900 | B2 * | 3/2014 | Rastegar | F42C 15/24 102/210 |
| 8,748,762 | B2 * | 6/2014 | Rastegar | H01H 35/141 200/61.45 R |
| 9,021,955 | B2 * | 5/2015 | Rastegar | F42C 11/02 102/210 |
| 9,097,502 | B2 * | 8/2015 | Rastegar | F42C 11/008 |
| 9,194,681 | B2 * | 11/2015 | Rastegar | F42C 11/008 |
| 9,207,054 | B2 | 12/2015 | Ireland et al. | |
| 9,470,497 | B2 * | 10/2016 | Rastegar | F42C 11/02 |
| 9,587,924 | B2 * | 3/2017 | Rastegar | F42C 15/40 |
| 9,733,055 | B2 * | 8/2017 | Radojevic | F42C 11/065 |
| 9,910,060 | B2 * | 3/2018 | Rastegar | G01P 15/001 |
| 10,337,848 | B2 * | 7/2019 | Rastegar | F42C 15/22 |
| 10,447,179 | B2 * | 10/2019 | Rastegar | F42C 11/02 |
| 10,581,347 | B2 * | 3/2020 | Rastegar | F42C 11/02 |
| 10,598,473 | B2 * | 3/2020 | Rastegar | F42C 11/008 |
| 11,125,543 | B1 | 9/2021 | Jankowski et al. | |
| 11,187,496 | B2 * | 11/2021 | Sullivan | F41G 3/22 |
| 11,248,893 | B2 * | 2/2022 | Rastegar | F42C 11/008 |
| 11,287,237 | B1 * | 3/2022 | Pirozzi | F42C 15/24 |
| 11,933,585 | B2 * | 3/2024 | Sullivan | F42B 12/72 |
| 12,013,221 | B2 * | 6/2024 | Rastegar | F42C 9/02 |
| 12,332,023 | B2 * | 6/2025 | Sullivan | F42B 10/32 |
| 2019/0063891 | A1 * | 2/2019 | Rastegar | H02N 2/181 |
| 2022/0154670 | A1 | 5/2022 | Coffee et al. | |

* cited by examiner

ARTILLERY ROUND WITH ROCKET MOTOR DELAY

BACKGROUND

Field

Embodiments of the present disclosure relate to the field of rocket-assisted artillery rounds. In one or more embodiments, the artillery round includes a smart delay for rocket motor ignition.

Description of the Related Art

Rocket-assisted artillery rounds have been developed to extend the range of artillery fired projectiles. The artillery round generally includes a high explosive warhead or other payload and a rocket motor. When the artillery round is fired, a pyrotechnic or other type of delay assembly is initiated. The delay assembly functions to delay the activation of the rocket motor relative to the initial setback (i.e., initial motion upon firing) of the artillery round. In conventional devices, the delay is typically a predetermined time, which can be embodied as the time to burn a delay fuse, such as approximately three seconds. The additional thrust provided by the rocket motor augments the velocity and consequently, the range of the artillery round. One example of a rocket-assisted artillery round is the M549 high-explosive rocket-assisted (HERA) 155 mm howitzer round.

Some modern military artillery rounds can be fired from more than one type of artillery piece. Additionally, some artillery pieces can file artillery rounds with different amounts of charges. Thus, delays of rocket-assisted artillery rounds fired from these types of artillery pieces often must be programmed in the field (i.e., at the artillery piece) prior to firing to identify the type of artillery piece and the amount of charge being utilized. This programming requirements creates logistical delays and is also suspect to operator error, leading to an inaccurately fired artillery round.

Accordingly, there is a need for an improved rocket-assisted artillery round.

SUMMARY

Rocket-assisted artillery rounds and methods for firing the same are described herein. In one example, a rocket-assisted artillery round includes a projectile body, rocket fuel disposed in the projectile body, an ignitor positioned to ignite the rocket fuel, and an ignition control system. The ignition control system includes a controller coupled to first and second sensors. The first sensor is configured to detect a first metric. The first metric is indicative of firing commencement of the projectile body. The second sensor is configured to detect a second metric. The second metric is indicative of set forward of the projectile body. The controller is configured to output an activation signal to the ignitor based on the first metric and the second metric.

In another example, a rocket-assisted artillery round is provided that includes a projectile body and an ignition control system disposed in the projectile body. A tactical payload, rocket fuel, an ignitor, and a power source are also disposed in the projectile body. The ignitor is positioned to ignite the rocket fuel. The power source is coupled to the ignition control system. The ignition control system includes a controller coupled to first and second sensors. The first sensor is configured to detect a first metric. The first metric is indicative of rotation of the projectile body. The second sensor is configured to detect a second metric. The second metric is indicative of setback of the projectile body. The controller is configured to output an activation signal to the ignitor based on the first metric and the second metric.

In some examples, the ignition control system is configured to output the activation signal to the ignitor based on the first metric exceeding a threshold criteria and the second metric exceeding a threshold criteria.

In some examples, the rocket-assisted artillery round includes a pressure sensor connected to a port open to an aft end of the artillery round and having an output connected to the ignition control system. The pressure sensor is operable to detect firing or energetics initiation pressure at the aft end of the artillery round. The controller of the ignition control system is further configured to output the activation signal to the ignitor only if firing or energetics initiation pressure is detected by the pressure sensor.

In some examples, the rocket-assisted artillery round includes safety circuitry configured to prevent activation of the ignitor when output of the pressure sensor does not meet a threshold criteria.

In some examples, the rocket-assisted artillery round includes a power source configured to provide power to the ignition circuitry when the artillery round is fired. The power source may optionally be a generator configured to provide power to the ignition control system in response to setback of the artillery round.

In some examples, the power source is at least one of a primary battery, a generator, thermal battery, a liquid reserve power source, or a capacitor.

In some example, the ignition control system of the rocket-assisted artillery round is disposed at an aft end of the projectile body. The second sensor is configured to detect pressure through a port formed through the projectile body.

In some examples, a normally open switch is coupled between a power source and the ignitor. The switch is operable to change to closed state based on receipt of the activation signal from the controller.

In some examples, ignition control system includes memory, storing an algorithm or a lookup table, coupled to a processor of the controller. The processor of the controller is configured to calculate a time delay for outputting the activation signal based on the sensed first and second metrics, an algorithm or a lookup table.

In yet another example, a method for firing a rocket-assisted artillery round is provided. The method includes sensing setback motion of the artillery round, sensing rotation of the artillery round; and igniting rocket fuel carried by the artillery round based on the sensed rotation and the sensed setback motion.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
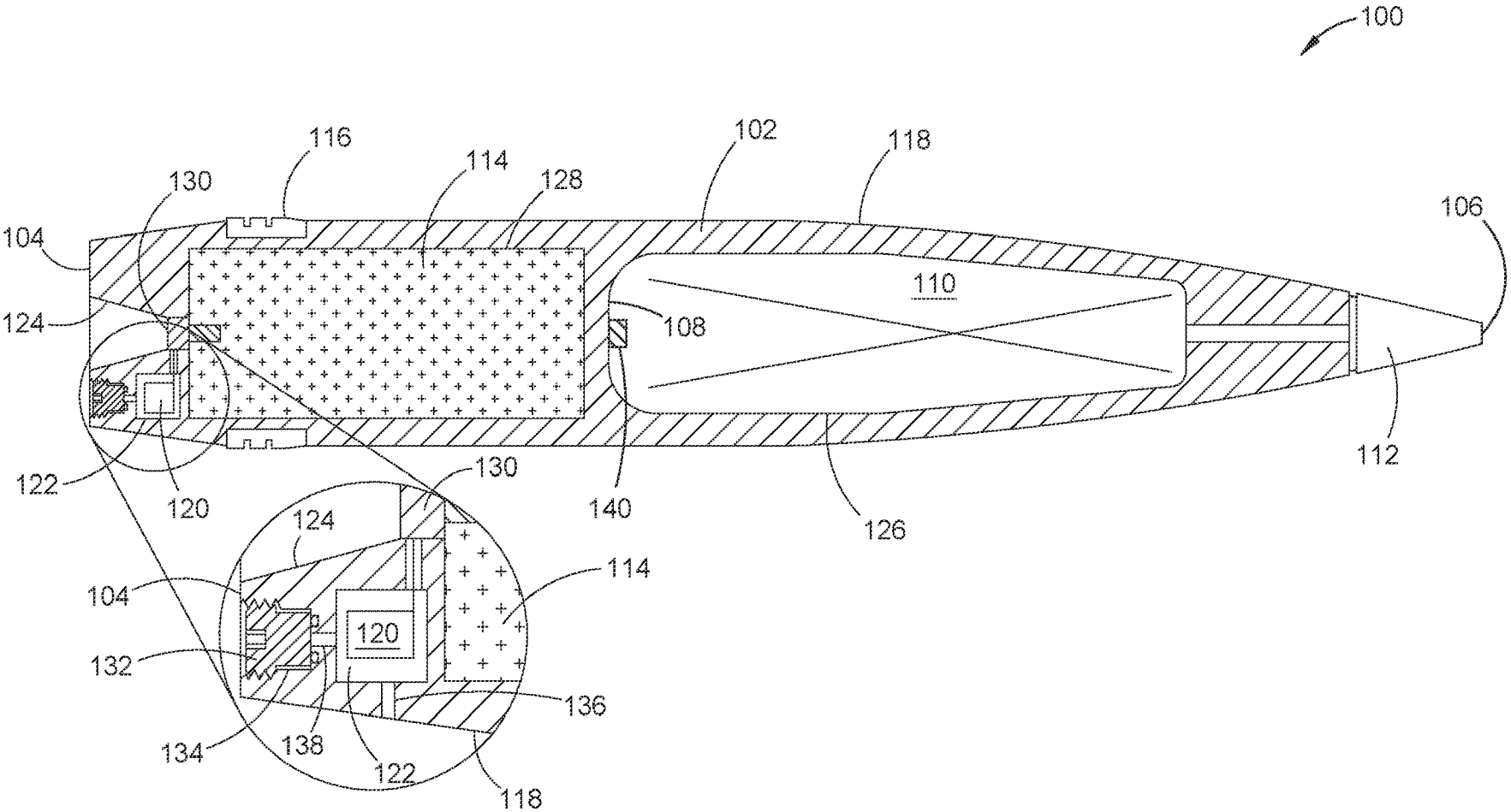
FIG. 1 is a schematic cross sectional view of one example of a rocket-assisted artillery round.

Embodiments of the present disclosure relate to the field of ammunition rounds and methods for firing the same. Although the disclosed technology is described as embodied in an artillery round, the disclosed technology may be deployed in other types of munitions. In one example, the artillery round is equipped with a rocket motor that fires after the artillery round is set forward (e.g., exits the muzzle of a weapon), thus significantly increasing the range and speed of the fired round. The artillery round is also equipped with a smart ignition control system that is on board (within) the round. The smart ignition control system is configured to sense a metric indicative of firing commencement and set forward of the artillery round, and to use the sensed metric indicative of firing commencement and set forward information to determine when, if at all, the rocket motor is to be fired. The smart ignition control system is also operable to set a delay for the rocket motor ignition based upon computation attribute and/or data from the sensed metrics. The data may be discrete data taken at a specific instance in time, or variable data taken over a period of time. In this manner, the rocket motor ignition delay is selected completely in-situ the artillery round incident with the act of firing, without any on site communication with the electronics of the control system as to the barrel length, rifling, or type of artillery piece being utilized to fire the round, and/or the amount of charge utilized to fire the round. Advantageously, the smart ignition control system allows the artillery round to be fired from different artillery pieces and even the same artillery piece with the different charges without having to program the rocket motor ignition delay in the field. Moreover, as the metric indicative of firing commencement and set forward are sensed in real time on board the artillery round at the time of firing, variation in flight performance due to differences in the actual amount of charge due to manufacturing variations is compensated for by the in-situ determination of the delay time based on the actual performance obtained during firing event. Thus, the rocket motor delay can be adjusted to provide more consistent and predictable flight paths for increased accuracy and repeatability, particularly from round to round.

In one example, the metric indicative of firing commencement may include any sensed metric indicative of set back. Sensed metric indicative of set back may sensing at least one or more metric selected from the group that includes barrel pressure, changes in gun barrel pressure, linear velocity or acceleration, and velocity or rotational acceleration, among other ballistic data obtained on board at the time of firing, exceeds a threshold. In another example, the metric indicative of firing commencement may alternatively or additionally include a magnitude of barrel pressure and/or a magnitude of velocity or acceleration.

In one example, the metric indicative of set forward includes at least one or more metric selected from the group that includes a change in barrel pressure, linear acceleration or velocity, and rotational acceleration or velocity, among other ballistic data obtained on board at the time of firing.

Although the smart ignition control system is primarily disclosed herein for setting the ignition delay of a rocket motor, the smart ignition control system can also be used in projectiles that are or are not rocket assisted to control the timing of expulsion of cargo carried by the projectile and/or detonate a tactical payload, such as explosives, carried by the projectile. Since filing performance is sensed in real time on board the artillery round at the time of firing, variation in flight performance due to differences in the actual amount of charge due to manufacturing variations is compensated for by the in-situ determination of the delay time based on the actual performance obtained during firing event. Thus, the delay from firing of the expulsion of cargo and/or detonation of the tactical payload can be adjusted real time on board the projectile at the time of firing to provide more accurate and repeatable weapon engagement with a target, particularly from round to round.

FIG. 1 is a cross sectional view of an artillery round 100 having a smart ignition control system 120, according to one implementation. The artillery round 100 includes an artillery round projectile body 102 having a forward end 106 and an aft end 104. The projectile body 102 is formed from brass, steel, copper or other suitable material. The projectile body 102 may also include a rotating band 116. The rotating band 116 is generally located near the aft end 104 of the projectile body 102. The rotating band 116 is fabricated from a soft metal, such as a gilding metal, copper, or lead, among others. When the artillery round 100 is fired, the pressure of the propellant swages the metal of the rotating band 116 into the rifling of the barrel and forms a seal. The rotating band 116 thus prevents propellant gases from blowing past the projectile body 102, while engaging the barrel's rifling to spin the artillery round 100 for a more accurate flight path.

The projectile body 102 also includes at least a forward cavity 126, an aft cavity 128, and a sensor cavity 122. The forward cavity 126 is generally isolated from the aft cavity 128 by a bulkhead 108. A tactical payload 110 is located in the forward cavity 126. In one example, the tactical payload 110 is a high explosive charge. In another example, the tactical payload 110 is a canister that can deliver other types of weapons. Other types of tactical payloads 110 may be alternatively utilized as commonly known or later developed. Detonation of the tactical payload 110 is, in one example, controlled by a warhead 112 fixed to the front end 106 of the projectile body 102. The warhead 112 may include an escapement and ignitor (not shown).

In other examples, the detonation of the tactical payload 110 is controlled by the ignition control system 120. The ignition control system 120 is connected to a payload ignitor 140. The payload ignitor 140 (i.e., a detonator) is activated by a signal from the ignition control system 120 so that the delay in activating the payload ignitor 140 and detonation of the tactical payload 110 is set using real time firing metrics obtained on board the projectile 200 as further described below.

The aft cavity 128 holds rocket fuel 114. The rocket fuel 114, when ignited by an ignitor 130 disposed near the aft end 104 of the projectile body 102, generates combustion products, generally gases, which are expelled out the aft end 104 of the projectile body 102 through a nozzle 124. The nozzle 124 accelerates the combustion products produced by the rocket fuel 114 to high velocities that propel the round 100 forward at a greatly increased speed. Ignition of the rocket fuel 114 is controlled by the smart ignition control system 120.

The smart ignition control system 120 is disposed in the sensor cavity 122. In one example the sensor cavity 122 is located near or at the aft end 104 of the projectile body 102. In one example, the sensor cavity 122 is coupled by a conduit 138 to a port 134 formed in the aft end 104 of the projectile body 102. The port 134 may be sealed with a removable plug 132. With the plug 132 removed, the sensor cavity 122 is exposed to the environment outside the aft end 104 of the projectile body 102. For example, when the round 100 is fired, the pressure within the barrel of the weapon would enter the sensor cavity 122 though the port 134.

The smart ignition control system 120 controls the operation of the ignitor 130. The smart ignition control system 120 is operable to output an activation signal that causes the ignitor 130 to ignite the rocket fuel 114 within the aft cavity 128. Operation of the smart ignition control system 120 is discussed in detail with reference to FIGS. 4-10 below. However, the smart ignition control system 120 may also be utilized in other types of artillery round, including rounds that carry rocket fuel 114 within the forward cavity 126.

Figure 2:
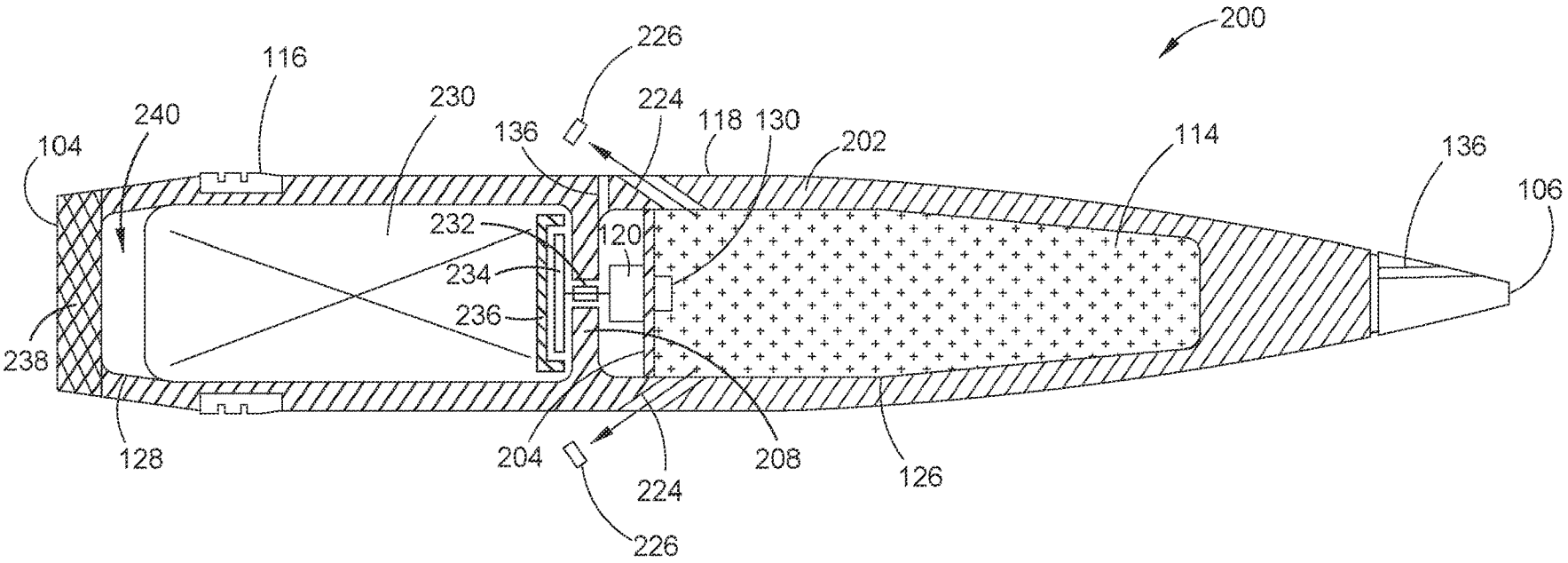
FIG. 2 is a schematic cross sectional view of another example of a rocket-assisted artillery round.

FIG. 2 is a schematic cross sectional view of another example of a rocket-assisted artillery round 200 configured to carry rocket fuel 114 within a forward cavity 126 of a projectile body 202, and having a smart ignition control system 120. A tactical payload 110 is carried in the aft cavity 128.

The projectile body 202 of the artillery round 200 is similar to a projectile body 102 utilized for the artillery round 100 described above, except wherein the projectile body 202 of the artillery round 200 includes two or more nozzles 224 disposed through the sidewalls 118 of the projectile body 202 and connected to the forward cavity 126 of the projectile body 202. Each nozzle 224 (two are shown) extends from the forward cavity 126 to an external surface of the projectile body 202. Environmental seals 226 (e.g., paper, plastic, cloth, or other covering) are positioned over the distal end of each nozzle 224 to protect the rocket fuel 114 from environmental exposure. In another embodiment, the environmental seal 226 may be located within the nozzle 224. Upon ignition of the rocket fuel 114, the environmental seal 226 is blown clear of the nozzle 224 by the combustion gases and pressure with the forward cavity 126 generated by the combustion of the rocket fuel 114. Each nozzle 224 is positioned at an angle relative to the center axis of the round 200 to facilitate expulsion of combustion gases as the rocket fuel 114 as the rocket fuel 114 combusts in a direction that propels the round 200 in a forward direction. In one example, the angle of each nozzle 224 relative to the center axis of the round 200 is 45 degrees or less. While two nozzles 224 are illustrated, it is to be noted that more or less than two powder two nozzles 224 may be utilized. The two nozzles 224 may be spaced at equal angular intervals (e.g., 90 degrees from one another when four powder channels are utilized) to facilitate ballistic flight.

Thus, the rocket fuel 114, when ignited by an ignitor 130 disposed within the projectile body 202, generate combustion products which are expelled out the sides of the projectile body 202 through the nozzles 224. The nozzle 224 accelerates the combustion products produced by the rocket fuel 114 to high velocities that propel the round 200 in a forward direction.

The ignition control system 120 and the ignitor 130 are generally located in or adjacent the forward cavity 126. In the example depicted in FIG. 2, the ignition control system 120 may be located adjacent the bulkhead 108. A separator 204 may optionally be disposed between the rocket fuel 114 and the ignition control system 120 to protect the ignition control system 120 from the heat and pressure generated by the combustion of the rocket fuel 114 after ignition.

The projectile body 202 of the artillery round 200 additionally includes a compartment 240 in which cargo 230 carried by the artillery round 200 is contained. The cargo 230 may include electronic payloads, flares, drones, chemical compositions (such as smoke screen generating compositions incendiary (fire-causing) compositions, illuminating compositions, and lethal/incapacitating agents), explosive specialty payloads (such as cluster bombs, grenades and mines), among others. The cargo 230 is generally expelled from the artillery round 200 once the artillery round 200 reaches a target, or after a delay initiated at firing. In the example depicted in FIG. 2, the tail end of the projectile body 202 includes a base cap 238 that seals the compartment 240 within the projectile body 202. To expel the cargo 230, an expulsion charge ignitor 232 is activated to set off an expulsion charge 234. The expulsion charge ignitor 232 may include an escapement (not shown) to prevent premature detonation. The expulsion charge 234 pushes a pusher plate 236 against the cargo 230 in a direction towards the base cap 238. The pressure of the expulsion charge 234 overcomes the connection between the base cap 238 and the projectile body 202, exposing the compartment to the ambient environment at the rear of the projectile 200, thus allowing the cargo 230 to be expelled out of the rear of the projective 200.

The expulsion charge ignitor 232 may have a delay set in any conventional manner. Alternatively and as shown in FIG. 2, the expulsion charge ignitor 232 is connected to the ignition control system 120 so that the delay in activating the activation of the expulsion charge ignitor 232 and expulsion of the cargo 230 is set using real time firing metrics obtained on board the projectile 200 as further described below.

Figure 3:
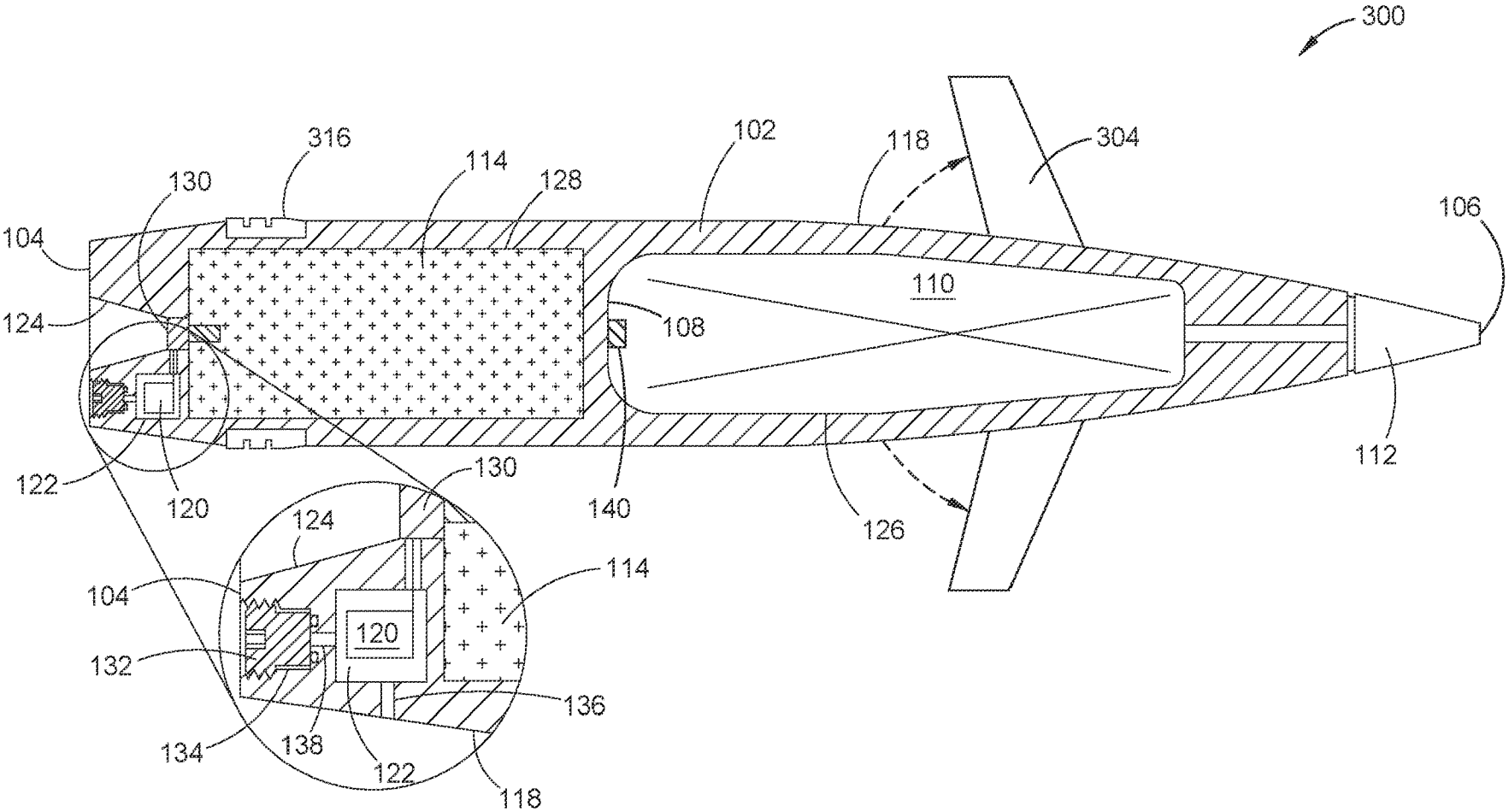
FIG. 3 is a schematic cross sectional view of another example of a rocket-assisted artillery round.

FIG. 3 is a cross sectional view of another artillery round 300 having a smart ignition control system 120, according to one implementation. The artillery round 300 is generally similar to either of the artillery rounds 100, 200, except that the artillery round 300 includes a slip band 316 instead of a rotation band 116. The slip band 316 generally spins on the projectile body 302, defeating the rifling of the gun barrel such that the artillery round 300 has little to no spin upon exiting the barrel. The projectile body 302 may include wings 304 that project outward from the projectile body 302 after the artillery round 300 has left the barrel to provide flight stabilization.

In the example depicted in FIG. 3, the smart ignition control system 120 is used to delay the ignition of the rocket fuel 114 as described herein with reference to the artillery round 100. In other examples, the smart ignition control system 120 may be used additionally or in the alternative to delay the ignition of the tactical payload 110 as described with reference to the artillery round 100 of FIG. 1, or to expel cargo 230 as described with reference to the artillery round 200 of FIG. 2.

Figure 4:
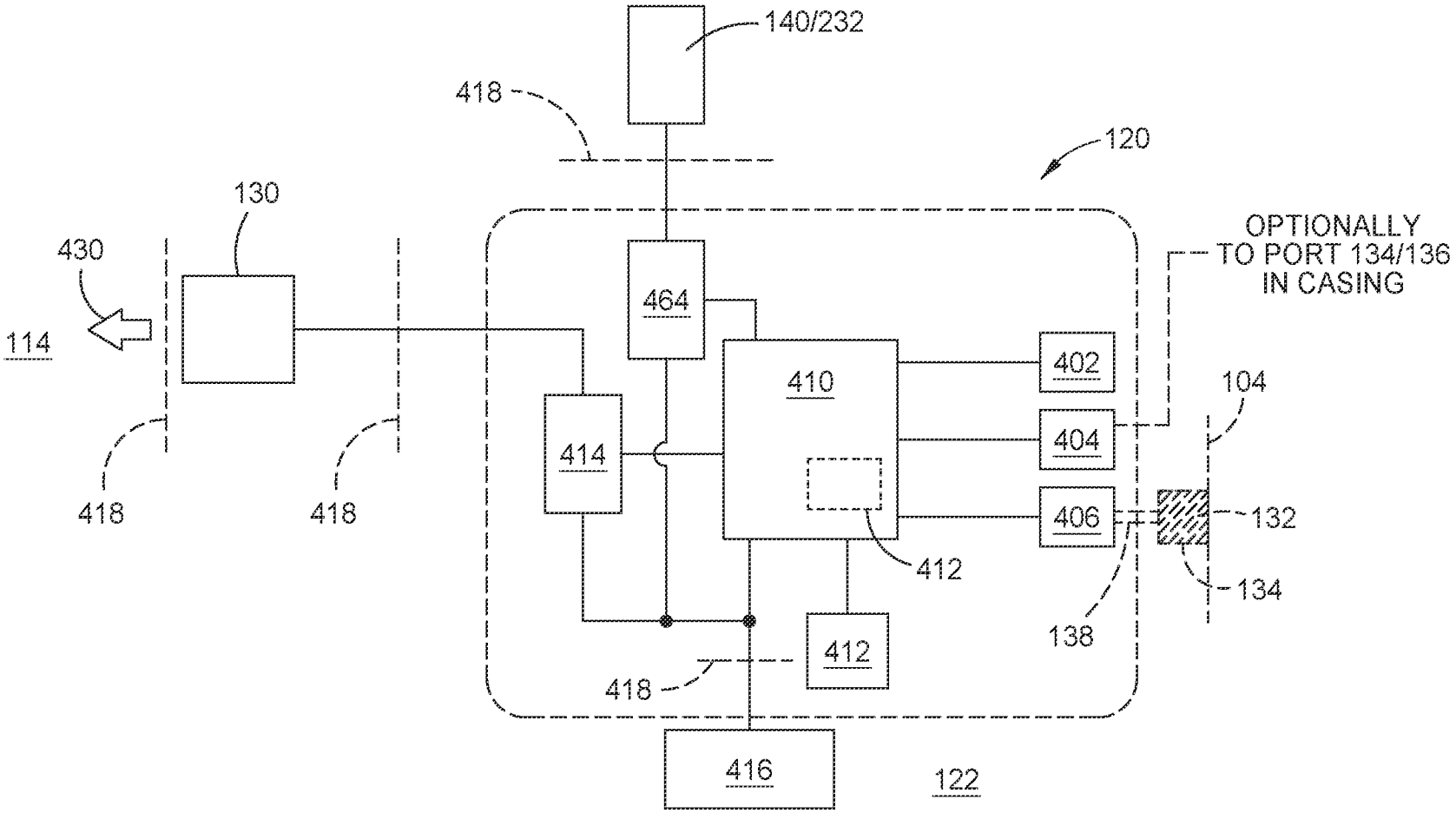
FIG. 4 is a schematic diagram of one example of a rocket ignition control system of the rocket-assisted artillery rounds of FIGS. 1, 2 and 3.

FIG. 4 is a schematic diagram of one example of the rocket ignition control system 120 of the rocket-assisted artillery rounds 100, 200, 300 of FIGS. 1, 2 and 3. It is also contemplated that the rocket ignition control system 120 may be used in rocket-assisted artillery rounds having other configurations.

The rocket ignition control system 120 has an input connected to a power source 416 and an output that controls the operation of the ignitor 130. The power source 416 is disposed within the projectile body of the rocket-assisted artillery round. The power source 416 may be configured to provide power to the ignition control circuitry 120 when the artillery round is fired. For example, the power source 416 may be configured to provide power to the ignition control circuitry 120 upon sensing that the sensing that the artillery round is fired. In such an example, the power source 416 may be embodied as a generator, a thermal battery, or a liquid reserve power source that provide powers to the ignition control system 120 in response to a sensed setback of the artillery round. In another example, the power source 416 may continuously provide power to the circuitry of the ignition control system 120. In other examples, the power source 416 may be at least one of a primary battery, or a capacitor.

A safety mechanism 418 may be disposed between the power source 416 and the ignition control system 120. The safety mechanism 418 may be a normally open electrical switch that closes in response to the setback of the round to allow power to flow through the safety mechanism 418 between the power source 416 and the ignition control system 120. The safety mechanism 418 may close electronically or manually in response to the setback of the artillery round.

The ignition control system 120 generally includes a first sensor 402, a second sensor 404, a controller 410, memory 412 and a switch 414. Outputs of the first and second sensors 402, 404 are connected to inputs to the controller 410. The memory 412 is generally solid state memory and may be connected to, or fabricated within, the integrated circuit chip that includes the circuitry of the controller 410.

An output of the controller 410 is connected to the switch 414. The power source 416 is connected through the switch 414 to the ignitor 130. The switch 414 is generally in a normally open state that disconnects the power source 416 from the ignitor 130. The switch 414 changes to closed state that connects the power source 416 to the ignitor 130 upon receipt of an activation signal provided by the controller 410 to the switch 414. Power provided by the source 416 to the ignitor 130 causes the ignitor 130 to fire (shown by arrow 430), igniting the rocket fuel 114, as described above.

One or more safety mechanisms 418 may optionally be used to prevent inadvertent ignition of the rocket fuel 114. One optional safety mechanism 418 disposed between the power source 416 and the controller 410 has been described above that prevents powering of the controller 410 and consequently prevents output of activation signal form the controller 410 to the switch 414.

In addition or alternatively to the optional safety mechanism 418 disposed between the power source 416 and the controller 410, an optional safety mechanism 418 may be disposed between the switch 414 and the ignitor 130. The safety mechanism 418 disposed between the switch 414 and the ignitor 130 is also configured as a normally open electrical switch that closes in response to the setback of the round to allow power to flow through the safety mechanism 418 between the power source 416 and the ignitor 130.

In additional or alternatively to one or both of the optional safety mechanisms 418 described above, an optional safety mechanism 418 may be disposed between the ignitor 130 and the rocket fuel 114. The safety mechanism 418 disposed between the ignitor 130 and the rocket fuel 114 is configured mechanically block the rocket fuel ignition charge generated by the ignitor 130 from reaching the rocket fuel 114. In one example, the safety mechanism 418 disposed between the ignitor 130 and the rocket fuel 114 is configured as a mechanical fuse escapement.

The first sensor 402 is configured to detect a first metric that is indicative of rotation of the projectile body 102, 202. The first sensor 402 may be accelerometer, a swing mass sensor, an inertial measurement sensor, and a gyroscope. An output of the first sensor 402 is provided as an input to the controller 410 of the ignition control system 120. The first metric detected by the first sensor 402 may be rotational velocity and/or rotational acceleration. Alternatively, the first metric detected by the first sensor 402 may another physical characteristic of the rotation of the round 100, 200, 300 from which rotational velocity and/or rotational acceleration of the round 100, 200, 300 may be derived.

The rotational velocity and/or rotational acceleration of the projectile body 102, 202 between setback and set forward of the artillery round 100, 200, 300 is indicative of the rifling and length of the barrel of the weapon being utilized to fire the round 100, 200, 300. The first metric measured by the first sensor 402 can be compared to information stored in the memory 412 by the controller 410 to determine which weapon and/or barrel length is being utilized to fire the artillery round 100, 200, 300. Thus, the ignition control system 120 can determine the type of artillery piece and/or barrel length of the artillery piece on board the artillery round 100, 200, 300 without any additional programming of the round other than the initial loading of library of artillery piece information into memory 412 at the time of manufacture. Accordingly, the first metric measured by the first sensor 402 can be utilized to determine the barrel length and rotational characteristics of the round 100, 200, 300 exiting the weapon which is then use for determining the delay desired for igniting the rocket fuel 114, and for providing a more predictable and consequently more accurate flight path.

Alternatively or in addition to using the rotational velocity and/or rotational acceleration of the projectile body 102, 202 to determine the artillery piece being utilized to fire the artillery round 100, 200, 300, changes in the rotational velocity and/or rotational acceleration of the projectile body 102, 202 can be used to determine the transition between setback and set forward of the artillery round 100, 200, 300. The transition to set forward is indicative of the artillery round 100, 200, 300 exiting the barrel of the weapon being utilized to fire the round 100, 200, 300. Thus, the first metric measured by the first sensor 402 can be utilized to determine a point in time in which the round 100, 200, 300 exits the weapon for use in determining the delay desired for igniting the rocket fuel 114.

The second sensor 404 is configured to detect a second metric that is indicative of the setback of the projectile body 102, 202. The second sensor 404 may be an accelerometer, an inertial measurement sensor, a pressure sensor, a pressure switch, a setback sensor or an impact sensor. When the second sensor 404 is configured as a pressure sensor, pressure ports 136 may be located though an exterior sidewall 118 of the projectile body 102, 202. The pressure ports 136 may optionally be located in the aft end 104 or front end 106 of the projectile body 102, 202, as shown in FIGS. 1 and 2. In some example, pressure may be provided to the second sensor 404 through the port 134 formed in the aft end 104 of the projectile body 102 when the plug 132 is removed.

Continuing to refer to FIG. 4, an output of the second sensor 404 is provided as an input to the controller 410 of the ignition control system 120. The second metric detected by the second sensor 404 may be linear velocity and/or linear acceleration. Alternatively, the second metric detected by the second sensor 404 may another physical characteristic of axial movement of the round 100, 200, 300 through the barrel of the weapon from which linear velocity and/or linear acceleration of the round 100, 200, 300 may be derived.

The linear velocity and/or linear acceleration of the projectile body 102, 202 between setback and set forward of the artillery round 100, 200, 300 is indicative of the propellant charge being utilized to fire the round 100, 200, 300 from the artillery piece. The second metric measured by the second sensor 404 can be compared to information stored in the memory 412 by the controller 410 to determine the amount of charge being utilized to fire the artillery round 100, 200, 300. Thus, the ignition control system 120 can determine the amount of charge actually being used to propel the artillery round 100, 200, 300 without any additional programming of the round other than the initial loading of library of artillery piece information into memory 412. As the amount of charge actually being used to propel the artillery round 100, 200, 300 is determined at the time of actual firing, variations in the charge utilized in the artillery piece are readily detectable and may be compensated for by setting the ignitor delay after setback in-situ the round by the onboard ignition control system 120.

Accordingly, along with the type of artillery piece and/or barrel length of the artillery piece derived by using the first sensor 402, the ignition control system 120 utilizes the amount of charge determined using the second sensor 404 for determining the delay desired for igniting the rocket fuel 114, without having to program the artillery round 100, 200, 300 at the artillery piece. Additionally, the type of artillery piece and/or barrel length of the artillery piece, and charge utilized to fire the round 100, 200, 300 derived in-situ firing of the round enables a more predictable and consequently more accurate flight path.

The controller 410 of the ignition control system 120 include a solid state processor that is configured to output the activation signal to the ignitor. The controller 410 additionally includes delay circuitry and other support circuitry. In one example, controller 410 is a field programmable gate array, an application-specific integrated circuit, or other suitable integrated circuit chip.

As discussed above, the controller 410 is configured to output an activation signal to the ignitor 130 based on the first metric and the second metric provided by the first and second sensors 402, 404. The controller 410 outputs the activation signal to the ignitor 130 based on the first metric exceeding a first threshold criteria and the second metric exceeding a second threshold criteria. The first threshold criteria may be one or both of a rotational velocity and/or rotational acceleration of the projectile body 102, 202. The second threshold criteria may be one or both of a linear velocity and/or linear acceleration of the projectile body 102, 202. The first and second threshold criteria may be stored in the memory 212 of the ignition control system 120. In one example, the first and second threshold criteria may be stored in a lookup table stored the memory 212. One the first and second threshold criteria are met, a corresponding delay time is retrieved from the lookup table. The circuitry of the controller 410 includes solid state timer relay circuitry or other suitable solid state delay circuitry. The solid state delay circuitry of the controller 410 of the ignition control system 120 waits for the delay time to expire, then outputs the activation signal to the ignitor 130. In one example, the activation signal output from the controller 410 changes the state of the switch 414 such that power is provided to the ignitor 130, thus triggering ignition of the rocket fuel 114.

In another example, the memory 212 of the ignition control system 120 may store an algorithm that is used to determine if the controller 410 is to output the activation signal to the ignitor 130, and to determine the delay that the controller 410 waits prior to outputting the activation signal. The first metric and the second metric provided by the first and second sensors 402, 404 are utilized as variables in the algorithm. The algorithm is processed by the processing circuitry of the controller 410 to determine a delay time. If the first and second metrics do not meet a predefined criteria, then the algorithm will not output a delay time and not activation signal is provided to the switch 414. If the first and second metrics meet the predefined criteria, then the algorithm determines a delay time. The controller 410 of the ignition control system 120 waits for the delay time to expire, then outputs the activation signal to the ignitor 130. In one example, the activation signal output from the controller 410 changes the state of the switch 414 such that power is provided to the ignitor 130, thus triggering ignition of the rocket fuel 114.

The ignition control system 120 may additionally include a third sensor 406. The third sensor 406 exposed to the port 134, for example through the conduit 138. The third sensor 406 may be disposed in the sensor cavity 122. When located in the sensor cavity 122, one or more of the other sensors 402, 404 of the ignition control system 120 may optionally be fluidly isolated from the third sensor 406, for example by epoxy, such that when the plug 132 is removed, only the third sensor 406 (and not one or more of the other sensors 402, 404) is exposed to the pressure within the barrel at the time of setback. In one example, the third sensor 406 may be exposed to the environment outside of the round 100 only when the plug 132 is removed, while the second sensor 404 disposed sensor cavity 122 is exposed to the environment outside of the round 100 through a separate pressure port 136 formed through the projectile body 102.

The third sensor 406 is operable to operable to detect firing or energetics initiation pressure at the aft end 104 of the artillery round 100 when the plug 132 is removed. The controller 410 of the ignition control system 120 is configured to permit output of the activation signal to the ignitor 130 (through the switch 414) only if firing or energetics initiation pressure is detected by the third sensor 406. Thus, the presence or absence of the plug 132 may be utilized as an on/off selector of the rocket motor of the round 100. For example, when the plug 132 seals the port 134 and prevents firing or energetics initiation pressure from being detected by the third sensor 406, the controller 410 of the ignition control system 120 will not issue an activation signal, and thus prevents the rocket fuel 114 from being ignited. Conversely, when the plug 132 is removed the port 134 and allows firing or energetics initiation pressure to be detected by the third sensor 406, the controller 410 of the ignition control system 120 will output the activation signal once the first and second metrics meet a predetermined criteria, and thus allows rocket fuel 114 to be ignited after expiration of the corresponding delay.

In some embodiments, the ignition control system 120 generates outputs that are coupled to one or more of the safety mechanisms 418. Each of the safety mechanisms 418 are configured to prevent activation of the ignitor 130. For example, the ignition control system 120 may be configured to output a signal that disengages the safety mechanisms 418 only once the first and second metrics meet the predetermined criteria. If the ignition control system 120 does not output a signal to disengage any of the safety mechanisms 418 present in the ignition control system 120, the ignitor 130 or the charge output by the 130 will fail to ignite the rocket fuel 114.

In some examples, the ignition control system 120 may alternatively or additionally be used to control the activation of the payload ignitor 140, such as shown in FIGS. 1 and 3, or control the activation of the expulsion ignitor 232, such as shown in FIG. 2. In such examples, a switch 464 is coupled to the power source 316, the controller 410 and one of the payload ignitor 140 or the expulsion ignitor 232. The switch 464 and the controller 410 controls the activation of the ignitors 140, 232 in the same manner that switch 414 and the controller 410 controls the activation of the ignitor 414.

Figure 5:
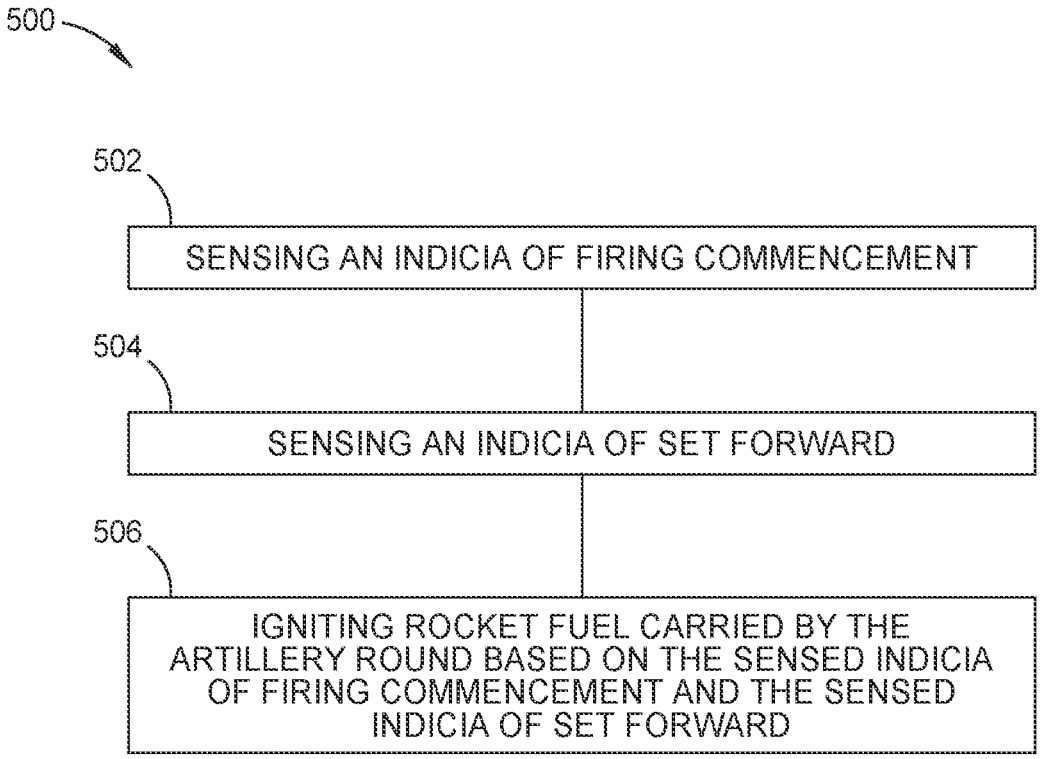
FIG. 5 is a block diagram of one example of a method for firing rocket-assisted artillery round.

FIG. 5 is a block diagram of one example of a method 500 for firing rocket-assisted artillery round, such as the artillery rounds 100, 200, 300 described above. The method 500 may also be utilized for firing rocket-assisted artillery rounds having other configurations.

The method 500 begins at operation 502 by sensing a metric indicative of firing commencement of the artillery round being fired from an artillery piece or other barrel or tube weapon. Prior to loading the artillery round in the artillery piece, information as to the type of artillery piece or charge being utilized by the artillery piece is not loaded locally at the site of the artillery piece. Information related to artillery pieces and charges which may be utilized in those artillery pieces in which the artillery round may be later fired in the field may be preloaded into the memory 412 at the time or manufacture, or at another point in the supply chain prior to arrival at the location of the actual artillery piece in which the artillery round is to be fired. In one example, the metric indicative of firing commencement is sensed by the first sensor 402 and provided to the ignition control system 120.

As discussed above, the metric indicative of firing commencement may include any sensed metric indicative of set back. Sensed metric indicative of set back may sensing that at least one or more metric selected from the group that includes barrel pressure, linear velocity or acceleration, and velocity or rotational acceleration, among others, exceeds a threshold. These metrics are indicative of firing commencement, and may be utilized to activate or turn on the power source 416 coupled to the controller 410, and/or turn off the safety mechanisms 418. In another example, the metric indicative of firing commencement may alternatively or additionally include a magnitude of barrel pressure and/or a magnitude of velocity or acceleration. These metrics may be utilized to activate or turn on the power source 416 coupled to the controller 410, turn off the safety mechanisms 418, and/or provide information indicative of the charge utilized to fire the artillery round from the gun.

At operation 504, set forward of the artillery round is sensed by the second sensor 404. In one example, the set forward of the artillery round sensed by the second sensor 404 is provided to the ignition control system 120. In one example, the metric indicative of set forward includes at least one or more of metric selected from the group that includes a change in barrel pressure, linear acceleration or velocity, and rotational acceleration or velocity, among others. The set forward information is utilized to determine when the artillery round leaves the barrel, which in conjunction with the metric indicative of firing commencement, is indicative of the barrel length of the gun (and thus, the gun type itself).

At operation 506, rocket fuel 114 carried by the artillery round is ignited in based on the sensed metric indicative of firing commencement (such as barrel pressure exceeding a threshold and/or the magnitude of barrel pressure) and the sensed metric indicative of set forward (such as a change in rotation of the artillery round 100). For example, the sensed indicative of firing commencement is provided to ignition control system 120 as a first metric, while the sensed set forward is provided to ignition control system 120 as a second metric. Based on the ignition control system 120 determining that the first and second metrics meet a predefined criteria, the ignition control system 120 outputs an activation signal that causes power to be provided to the ignitor 130, which ignites the rocket fuel 114. The ignition control system 120 also determines a delay time which is waited to expire prior to outputting the activation signal. The delay time may be calculated using the first and second metrics as variables. The delay time may alternatively be retrieved from a look-up table stored in memory 412 on board the artillery round corresponding to the first and second metrics.

In one example, the delay is based on part on that sensed rotational of the artillery round. In another example, the delay is based at least in part on sensing a pressure applied to an aft end of the artillery round. In another example, the delay is calculated by controller disposed on board the artillery round.

Figure 6:
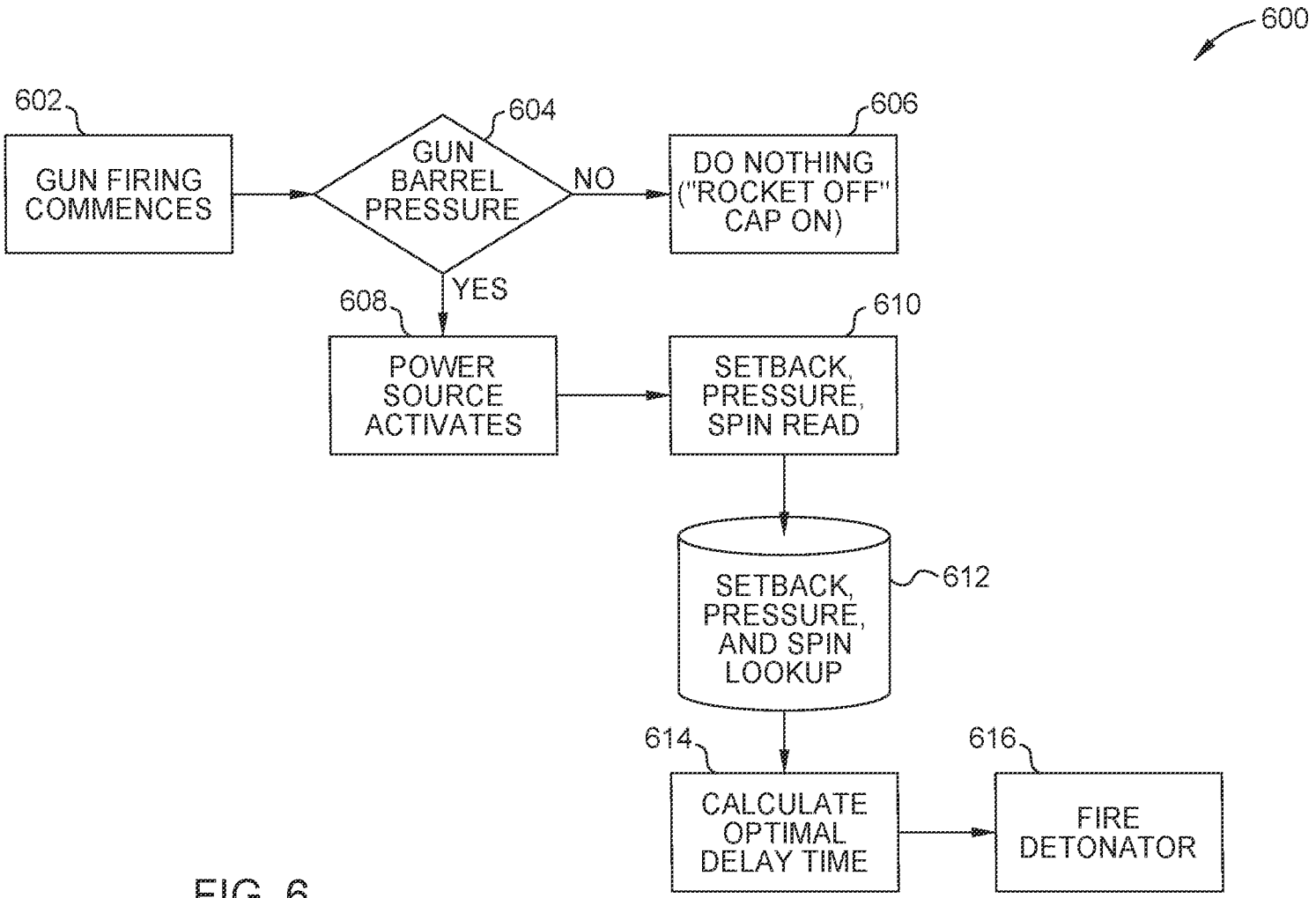
FIG. 6 is another block diagram of one example of a method for firing rocket-assisted artillery round.

FIG. 6 is block diagram of another example of a method 600 for firing rocket-assisted artillery round, such as the artillery round 100 described above. The method 600 may also be utilized for firing rocket-assisted artillery rounds having other configurations.

The method 600 begins at operation 602 by commencing firing the artillery round from the gun (i.e., artillery piece or other weapon that utilizes a rifled barrel). At operation 602, the gun barrel pressure utilized to launch the artillery round from the gun is read. The gun barrel pressure may be read by the third sensor 406.

If the plug 132 is in place and preventing the gun barrel pressure to be read by the third sensor 406, the method 600 proceeds to operation 606 where no further action is taken by the ignition control system and the artillery round is fired on a trajectory independent of the use of the rocket motor. Stated differently, when the plug 132 is in place, the rocket motor is off and does not ignite.

If the plug 132 has been removed, allowing the gun barrel pressure to be read by the third sensor 406, the method 600 proceeds to operation 608. Stated differently, when the plug 132 is removed, the rocket motor is "on" and will ignite subject to additional sensed criteria meeting predefined thresholds.

At operation 608, the power source 416 activates. In one example, power source 416 activates by turning on a power generator or activating a thermal battery or a liquid reserve power source to power the ignition control system 120 and provide power to the normally closed switch 414. In another example, the safety mechanism 418 disposed between power source 416 and the ignition control system 120 changes from an electrically open to a closed state that allows power from the power source 416 to turn on the ignition control system 120 and provide power to the normally closed switch 414.

At operation 610, the setback, pressure and spin of the artillery round are read by the sensors 402, 404, 406. Metrics indicative of the setback, pressure and spin of the artillery round is provided by the sensors 402, 404, 406 to the ignition control system 120.

At operation 612, the ignition control system 120 compares the metrics indicative of the setback, pressure and spin of the artillery round sensed by the sensors 402, 404, 406 to information stored in a look-up table residing in the memory 412 of the ignition control system 120. The information in the look-up table enables the amount of charge and type of artillery piece firing the artillery round to be determined (i.e., barrel length, rifling, etc.), from which a corresponding rocket fuel ignition, rocket payload expulsion, or other delay may be calculated or otherwise determined at operation 614. Additionally or in the alternative, the information in the look-up table may utilized to provide the spin rate and velocity of the artillery round at setback, from which a corresponding activation delay may be calculated or otherwise determined at operation 614.

At operation 616, the ignition control system 120 outputs an activation signal based the expiration of the delay determined at operation 614 to trigger a post-set forward event on board the artillery round 100. In one example, the activation signal causes the ignitor 130 to be fired based on the delay determined at operation 614. In one example, the ignition control system 120 waits for the delay period to expire prior to outputting an activation signal that causes the ignitor 130 to fire, igniting the rocket fuel 114 and consequentially boosting the range and speed of the artillery round. In another example, the ignition control system 120 waits for the delay period to expire prior to outputting an activation signal that causes the ignitor 140 to fire, causing detonation of the tactical payload 110 of the artillery round. The ignition control system 120 can be configured to control the function of either or both the ignitors 130, 140.

Figure 7:
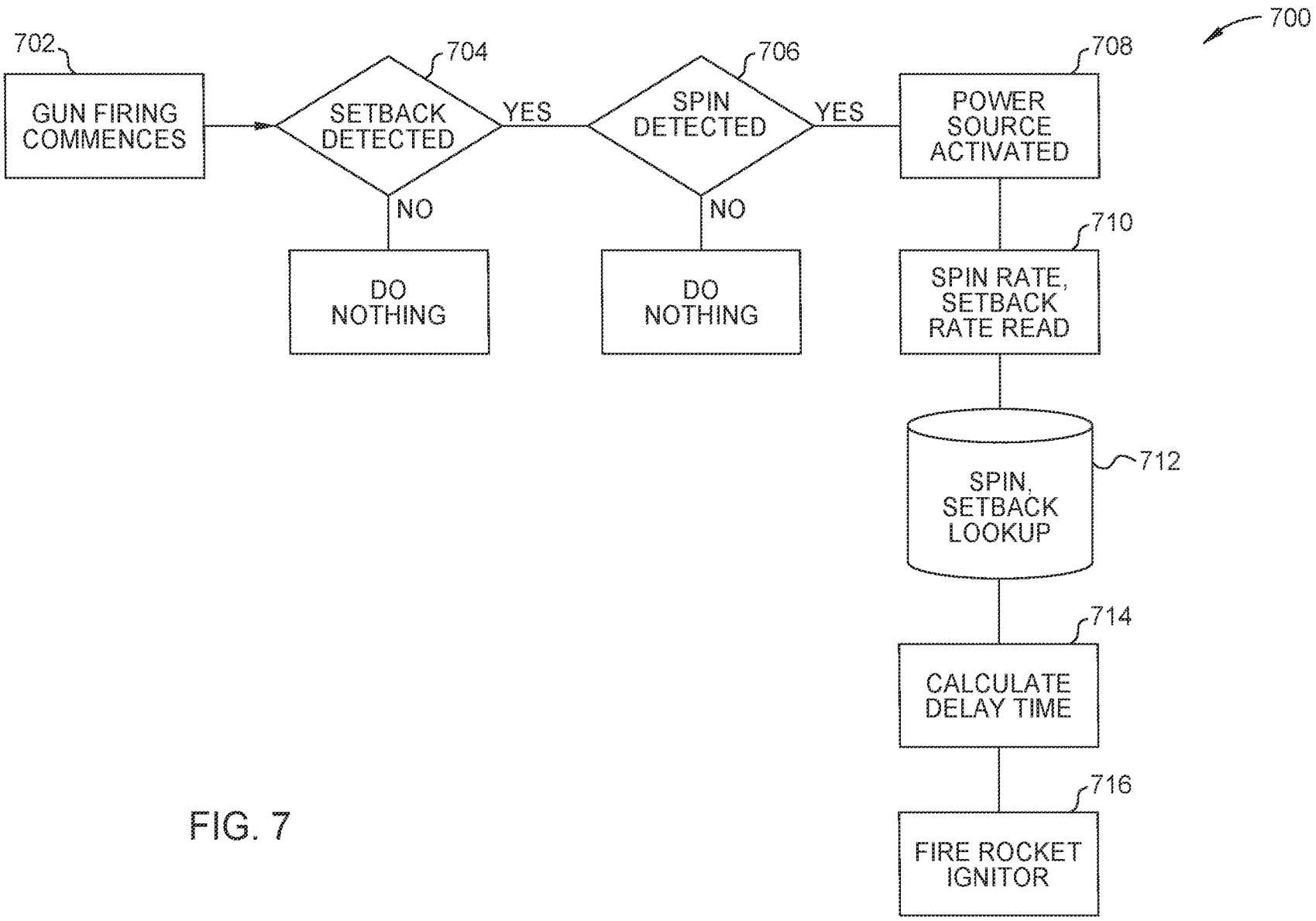
FIG. 7 is another block diagram of one example of a method for firing rocket-assisted artillery round.

FIG. 7 is block diagram of another example of a method 700 for firing rocket-assisted artillery round, such as the artillery round 200 described above. The method 700 may also be utilized for firing rocket-assisted artillery rounds having other configurations.

The method 700 begins at operation 702 by commencing firing the artillery round from the gun. At operation 702, set back of the artillery round is detected on board the artillery round as described above. In one example, set back may be detected by sensing the gun barrel pressure utilized to launch the artillery round from the gun is greater than a threshold. Additionally or in the alternative, the magnitude of the gun barrel pressure utilized to launch the artillery round from the gun may be determined. The gun barrel pressure may be read by the third sensor 406.

If no set back is detected at operation 704, the method 700 ends by the control system 120 doing nothing (i.e., not issuing an ignitor activation signal). If set back is detected at operation 704, the method 700 proceeds to operation 706.

At operation 706, spin (e.g., rotation) of the artillery round is detected. If the no rotation is detected at operation 706, the method 700 ends by the control system 120 doing nothing (i.e., not issuing an ignitor activation signal). If rotation is detected at operation 706, the method 700 proceeds to operation 708.

Although the flow diagram of FIG. 7 illustrates operation 704 being performed prior to operation 706, operation 706 may be performed prior to operation 704.

Based on both set back being detected at operation 704 and rotation being detected at operation 706, the power source 416 is activated at operation 708. In one example, power source 416 activates by turning on a power generator or activating a thermal battery or a liquid reserve power source to power the ignition control system 120 and provide power to the normally closed switch 414. In another example, the safety mechanism 418 disposed between power source 416 and the ignition control system 120 changes from an electrically open to a closed state that allows power from the power source 416 to turn on the ignition control system 120 and provide power to the normally closed switch 414.

At operation 710, setback rate and spin rate of the artillery round advancing through the gun barrel are read by the sensors 402, 404 (and optionally 406). Metrics indicative of the setback rate and spin rate of the artillery round are provided by the sensors 402, 404 to the ignition control system 120.

At operation 712, the ignition control system 120 compares the metrics indicative of the setback, pressure and spin of the artillery round sensed by the sensors 402, 404 to information stored in a look-up table residing in the memory 412 of the ignition control system 120. The information in the look-up table enables the amount of charge and type of artillery piece firing the artillery round to be determined (i.e., barrel length, rifling, etc.), from which a corresponding delay in rocket fuel ignition, rocket payload expulsion, payload detonation or other delay may be calculated or otherwise determined at operation 714. Additionally or in the alternative, the information in the look-up table may utilized to provide the spin rate and velocity of the artillery round at setback, from which a corresponding activation delay may be calculated or otherwise determined at operation 714.

At operation 716, the ignition control system 120 outputs an activation signal based the expiration of the delay determined at operation 714 to trigger a post-set forward event on board the artillery round 100. In one example, the activation signal causes the ignitor 130 to be fired based on the delay determined at operation 714. In one example, the ignition control system 120 waits for the delay period to expire prior to outputting an activation signal that causes the ignitor 130 to fire, igniting the rocket fuel 114 and consequentially boosting the range and speed of the artillery round. In another example, the activation signal causes the ignitor 232 to be fired based on the delay determined at operation 714. In one example, the ignition control system 120 waits for the delay period to expire prior to outputting an activation signal that causes the ignitor 232 to fire, activating the charge 234 which expels the cargo 230 out of the artillery round. The ignition control system 120 can be configured to control the function of either or both the ignitors 130, 232.

Figure 8:
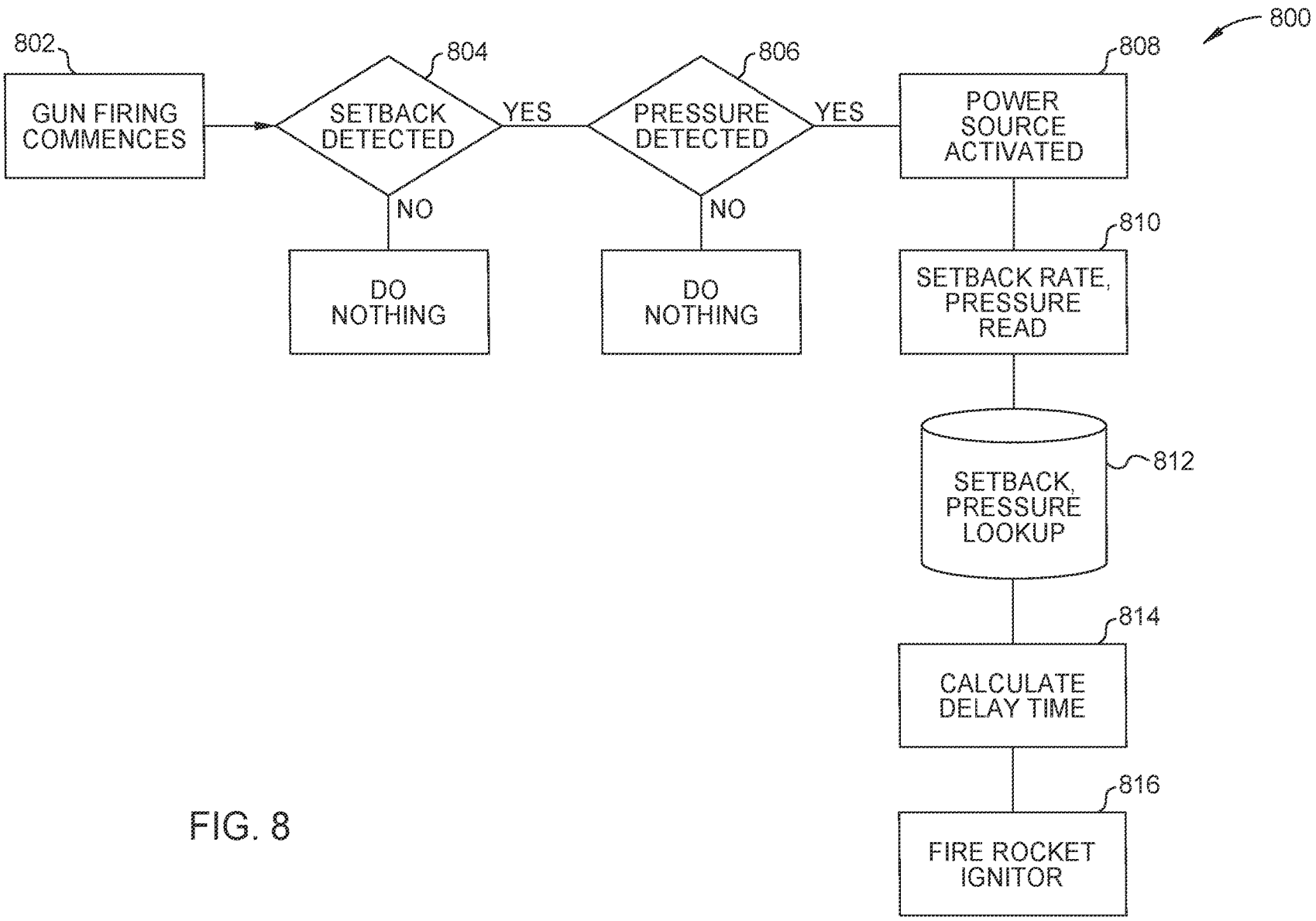
FIG. 8 is another block diagram of one example of a method for firing rocket-assisted artillery round.

FIG. 8 is block diagram of another example of a method 800 for firing rocket-assisted artillery round, such as the artillery round 300 described above. The method 800 may also be utilized for firing rocket-assisted artillery rounds having other configurations.

The method 800 begins at operation 802 by commencing firing the artillery round from the gun. At operation 802, set back of the artillery round is detected on board the artillery round. Set back may be detected by sensing, on board the artillery round that the acceleration of the artillery round or the pressure in the gun barrel is greater than a threshold, or via another suitable metric.

If no set back is detected at operation 804, the method 800 ends by the control system 120 doing nothing (i.e., not issuing an ignitor activation signal). If set back is detected at operation 804, the method 800 proceeds to operation 806.

At operation 806, pressure within the gun barrel firing the artillery round is detected. If the no pressure is detected at operation 806, the method 800 ends by the control system 120 doing nothing (i.e., not issuing an ignitor activation signal). If rotation is detected at operation 806, the method 800 proceeds to operation 808.

Although the flow diagram of FIG. 8 illustrates operation 804 being performed prior to operation 806, operation 806 may be performed prior to operation 804.

Based on both set back being detected at operation 804 and pressure being detected at operation 806, the power source 416 is activated at operation 808. In one example, power source 416 activates by turning on a power generator or activating a thermal battery or a liquid reserve power source to power the ignition control system 120 and provide power to the normally closed switch 414. In another example, the safety mechanism 418 disposed between power source 416 and the ignition control system 120 changes from an electrically open to a closed state that allows power from the power source 416 to turn on the ignition control system 120 and provide power to the normally closed switch 414.

At operation 810, setback rate of the artillery round and the pressure in the gun barrel are read by the sensors 402, 404 (and optionally 406). Metrics indicative of the setback rate and the magnitude of the barrel pressure are provided by the sensors 402, 404 to the ignition control system 120.

At operation 812, the ignition control system 120 compares the metrics indicative of the setback rate and pressure sensed by the sensors 402, 404 to information stored in a look-up table residing in the memory 412 of the ignition control system 120. The information in the look-up table enables the delay in rocket fuel ignition, tactical payload detonation, or other delay be calculated or otherwise determined at operation 814 to be selected based on the sensed setback rate and pressure.

At operation 816, the ignition control system 120 outputs an activation signal based the expiration of the delay determined at operation 814 to trigger a post-set forward event on board the artillery round 100. In one example, the activation signal causes the ignitor 130 to be fired based on the delay determined at operation 814. In one example, the ignition control system 120 waits for the delay period to expire prior to outputting an activation signal that causes the ignitor 130 to fire, igniting the rocket fuel 114 and consequentially boosting the range and speed of the artillery round. In another example, the activation signal causes the ignitor 140 to be fired based on the delay determined at operation 814. In one example, the ignition control system 120 waits for the delay period to expire prior to outputting an activation signal that causes the ignitor 140 to output an activation signal that causes power to be provided to the ignitor 140, which detonates the tactical payload 110. The ignition control system 120 also determines a delay time which is waited to expire prior to outputting the activation signal which detonates the tactical payload 110. The delay time may be calculated using the sensed setback rate and pressure as variables. The delay time may alternatively be retrieved from a look-up table stored in memory 412 on board the artillery round corresponding to the sensed the sensed setback rate and pressure. The ignition control system 120 can be configured to control the function of either or both the ignitors 130, 140.

Figure 9:
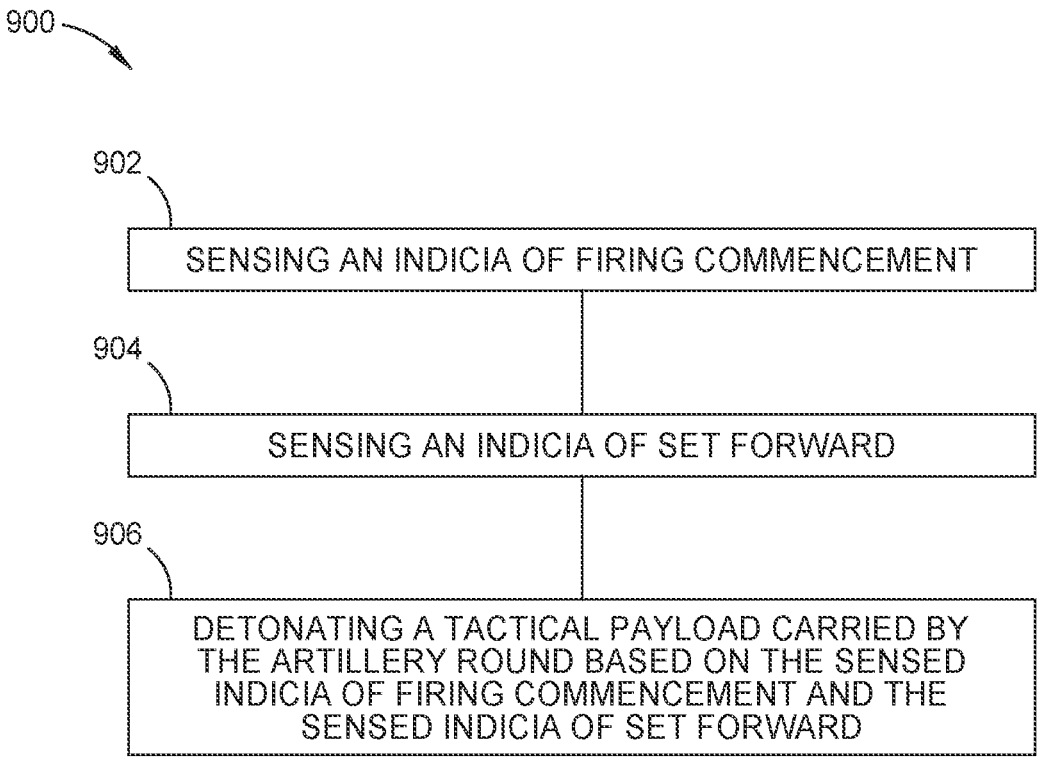
FIG. 9 is a block diagram of one example of a method for detonating a tactical payload carried by an artillery round.

FIG. 9 is a block diagram of one example of a method 900 for detonating a tactical payload carried by an artillery round, such as the artillery rounds 100, 300 described above, among others. The method 900 may be utilized for detonating tactical payloads of either rocket-assisted artillery rounds or non-rocket-assisted artillery rounds.

The method 900 of FIG. 9 begins at operation 902 by sensing a metric indicative of firing commencement of the artillery round being fired from an artillery piece or other barrel or tube weapon. As discussed above, the metric indicative of firing commencement may include any sensed metric indicative of set back. These metrics are indicative of firing commencement, and may be utilized to activate or turn on the power source 416 coupled to the controller 410, and/or turn off the safety mechanisms 418. In another example, the metric indicative of firing commencement may alternatively or additionally include a magnitude of barrel pressure and/or a magnitude of velocity or acceleration. These metrics may be utilized to activate or turn on the power source 416 coupled to the controller 410, turn off the safety mechanisms 418, and/or provide information indicative of the charge utilized to fire the artillery round from the gun.

At operation 904, set forward of the artillery round is sensed by the second sensor 404. In one example, the set forward of the artillery round sensed by the second sensor 404 is provided to the ignition control system 120. In one example, the metric indicative of set forward includes at least one or more of metric selected from the group that a change in barrel pressure, linear acceleration or velocity, and rotational acceleration or velocity, among others.

At operation 906, the tactical payload 110 carried by the artillery round is detonated in based on the sensed metric indicative of firing commencement (such as barrel pressure exceeding a threshold and/or the magnitude of barrel pressure) and the sensed metric indicative of set forward (such as a change in rotation of the artillery round 100). For example, the sensed indicative of firing commencement is provided to ignition control system 120 as a first metric, while the sensed set forward is provided to ignition control system 120 as a second metric. Based on the ignition control system 120 determining that the first and second metrics meet a predefined criteria, the ignition control system 120 outputs an activation signal that causes power to be provided to the ignitor 140, which detonates the tactical payload 110. The ignition control system 120 also determines a delay time which is waited to expire prior to outputting the activation signal which detonates the tactical payload 110. The delay time may be calculated using the first and second metrics as variables. The delay time may alternatively be retrieved from a look-up table stored in memory 412 on board the artillery round corresponding to the first and second metrics.

In one example, the delay is based on part on that sensed rotational of the artillery round. In another example, the delay is based at least in part on sensing a pressure applied to an aft end of the artillery round. In another example, the delay is calculated by controller disposed on board the artillery round. Thus, the method 900 enables the delay from firing the artillery round to detonation of the tactical payload 110 to be determined on board the artillery round based on the actual real time physics of the launch, such as the charge used to launch the round and the type of gun being utilized to fire the round, which improves the delivery accuracy of the weapon to a target.

Figure 10:
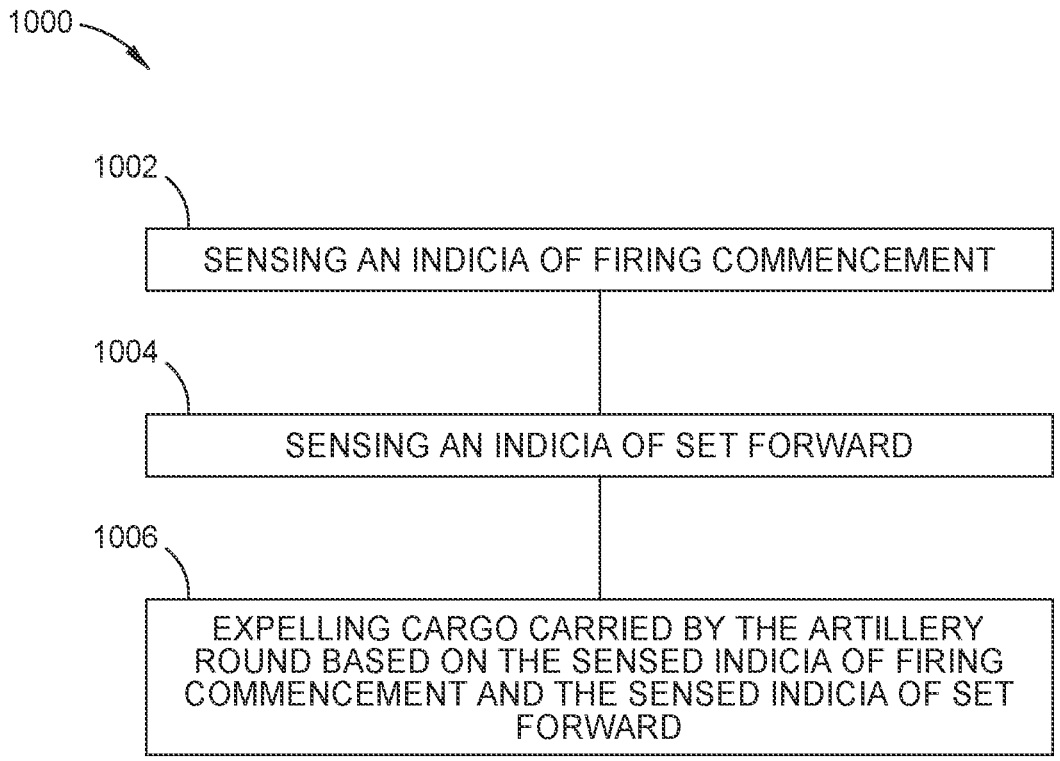
FIG. 10 is a block diagram of one example of a method for expelling cargo carried by an artillery round.

FIG. 10 is a block diagram of one example of a method 1000 for expelling cargo 230 carried by an artillery round, such as the artillery round 200 described above, among others. The method 1000 may be utilized for expelling cargo of either rocket-assisted artillery rounds or non-rocket-assisted artillery rounds.

The method 1000 of FIG. 10 begins at operation 1002 by sensing a metric indicative of firing commencement of the artillery round being fired from an artillery piece or other barrel or tube weapon. As discussed above, the metric indicative of firing commencement may include any sensed metric indicative of set back. These metrics are indicative of firing commencement, and may be utilized to activate or turn on the power source 416 coupled to the controller 410, and/or turn off the safety mechanisms 418. In another example, the metric indicative of firing commencement may alternatively or additionally include a magnitude of barrel pressure and/or a magnitude of velocity or acceleration. These metrics may be utilized to activate or turn on the power source 416 coupled to the controller 410, turn off the safety mechanisms 418, and/or provide information indicative of the charge utilized to fire the artillery round from the gun.

At operation 1004, set forward of the artillery round is sensed by the second sensor 404. In one example, the set forward of the artillery round sensed by the second sensor 404 is provided to the ignition control system 120. In one example, the metric indicative of set forward includes at least one or more of metric selected from the group that a change in barrel pressure, linear acceleration or velocity, and rotational acceleration or velocity, among others.

At operation 1006, cargo 230 carried by the artillery round is expelled from the round based on the sensed metric indicative of firing commencement (such as barrel pressure exceeding a threshold and/or the magnitude of barrel pressure) and the sensed metric indicative of set forward (such as a change in rotation of the artillery round 100). For example, the sensed indicative of firing commencement is provided to ignition control system 120 as a first metric, while the sensed set forward is provided to ignition control system 120 as a second metric. Based on the ignition control system 120 determining that the first and second metrics meet a predefined criteria, the ignition control system 120 outputs an activation signal that causes power to be provided to the ignitor 232, which detonates the charge 234 that expels the cargo 230 from the aft end 104 or other portion of the projectile body 202. The ignition control system 120 also determines a delay time which is waited to expire prior to outputting the activation signal which expels the cargo 230. The delay time may be calculated using the first and second metrics as variables. The delay time may alternatively be retrieved from a look-up table stored in memory 412 on board the artillery round corresponding to the first and second metrics.

In one example, the delay is based on part on that sensed rotational of the artillery round. In another example, the delay is based at least in part on sensing a pressure applied to an aft end of the artillery round. In another example, the delay is calculated by controller disposed on board the artillery round. Thus, the method 1000 enables the delay from firing the artillery round to be determined on board the artillery round based on the actual real time physics of the launch, such as the charge used to launch the round and the type of gun being utilized to fire the round, which improves the delivery accuracy of the weapon to a target.

Thus, rocket-assisted artillery rounds and methods for firing the same have been disclosed that utilizes an on-board smart ignition control system to both determine if the rocket motor should be fired, and if fired, how long the rocket motor ignition delay should be prior to igniting the rocket fuel. The rocket motor ignition delay is determined utilizing information contained and sensed on-board the artillery round without need for additional information obtained at the artillery piece, such as the amount of charge being utilized or the type of artillery piece being used to fire the round. In this manner, the artillery round may be fired from different artillery pieces and/or with different charges without having to reprogram the rocket motor delay, as the smart ignition control system disposed on-board the artillery round can determine that information and determine the rocket motor ignition delay using information sensed on-board the artillery round at the time of firing. Thus, the rocket-assisted artillery round with on-board smart ignition control system enables a more flexible supply chain for ordinance distribution, and reduces the time needed to prepare a round for firing. The on-board smart ignition control system also enables variation in spin and linear velocity to be compensated for by in-situ adjusting the rocket motor delay, making the trajectory and accuracy of the rocket-assisted artillery round more predictable and repeatable, round to round and gun to gun.

Other disclosed examples include rocket-assisted and non-rocket-assisted artillery rounds and methods for detonating tactical payloads and/or expelling cargo that utilizes the on-board smart ignition control system to determine the timing of those events relative to the firing of the round. Since firing performance is sensed in real time on board the artillery round at the time of firing, variation in flight performance due to differences in the actual amount of charge due to manufacturing variations is compensated for by the in-situ determination of the delay time for weapon detonation or cargo expulsion based on the actual performance obtained during firing event. Thus, the delay from firing of the expulsion of cargo and/or detonation of the tactical payload can be adjusted real time on board the projectile to provide more accurate and repeatable weapon engagement with a target, particularly from round to round.

What is claimed is:

1. An artillery round comprising:

a projectile body; and a delay control system disposed in the projectile body, the delay control system comprising:

a first sensor configured to detect a magnitude of a first metric, the first metric indicative of commencement of firing of the projectile body, wherein the first metric is a rate of forward acceleration;

a second sensor configured to detect a magnitude of a second metric, the second metric indicative of set forward of the projectile body; and a controller configured to calculate a timing of an activation output signal based on the magnitude of the first metric and the magnitude of the second metric detected by the first and second sensors.

2. The artillery round of claim 1, wherein the first sensor is selected from the group consisting of an accelerometer, a swing mass sensor, an inertial measurement sensor, and a gyroscope.

3. The artillery round of claim 1, wherein the second sensor is selected from the group consisting of an accelerometer, an inertial measurement sensor, a pressure sensor, a pressure switch, and an impact sensor.

4. The artillery round of claim 1, wherein the delay control system is configured to output the activation signal based on the first metric exceeding a threshold criteria and the second metric exceeding a threshold criteria.

5. The artillery round of claim 1 further comprising:

a pressure sensor connected to a port open to an aft end of the artillery round and having an output connected to the delay control system, the pressure sensor operable to detect firing or energetics initiation pressure at the aft end of the artillery round.

6. The artillery round of claim 5 further comprising safety circuitry, the safety circuitry configured to prevent activation based on the output of the activation signal when output of the pressure sensor does not meet a threshold criteria.

7. The artillery round of claim 1 further comprising:

a power source configured to provide power to the delay control system when the artillery round is fired.

8. The artillery round of claim 7, wherein the power source is a generator configured to provide power to the delay control system in response to setback of the artillery round.

9. The artillery round of claim 7, wherein the power source is at least one of a primary battery, a generator, a thermal battery, a liquid reserve power source, or a capacitor.

10. The artillery round of claim 5, wherein the controller of the delay control system is further configured to output the activation signal only if firing or energetics initiation pressure is detected by the pressure sensor.

11. The artillery round of claim 1, wherein the delay control system is disposed in a front portion of the projectile body.

12. The artillery round of claim 11, wherein the second sensor is configured to sense pressure through a side and/or front of the projectile body.

13. The artillery round of claim 1, wherein the delay control system further comprises:

a normally open switch coupled between a power source and an ignitor, the switch operable to change to closed state based on receipt of the activation signal from the controller.

14. The artillery round of claim 1, wherein the delay control system further comprises:

memory, storing an algorithm or a lookup table, coupled to a processor of the controller, the processor of the controller configured to calculate a time delay for outputting the activation signal based on the sensed first and second metrics, and the algorithm or a lookup table.

15. The artillery round of claim 14, wherein the processor of the controller is configured to calculate the time delay for outputting the activation signal based on the sensed first and second metrics, and the algorithm and/or a lookup table.

16. The artillery round of claim 1, wherein the second sensor is configured to detect spin rate.

17. An artillery round comprising:

a projectile body; and a delay control system disposed in the projectile body, the control system comprising:

a first sensor configured to detect a first metric indicative of commencement of firing of the projectile body, the first metric indicative of a magnitude of a rate of forward acceleration of the projectile body;

a second sensor configured to detect a second metric, the second metric indicative of a magnitude of gun barrel pressure or a magnitude of spin rate induced by firing of the artillery round; and a controller configured to calculate a timing of an activation output signal based on the magnitudes of the first and second metrics detected by the first and second sensors.

18. The artillery round of claim 17, wherein the delay control system is configured to output the activation signal based on the rate of the first metric exceeding a threshold criteria and the second metric exceeding a threshold criteria.

19. The artillery round of claim 17 further comprising safety circuitry, the safety circuitry configured to prevent activation based on the output of the activation signal when output of the second sensor does not meet a threshold criteria.

20. The artillery round of claim 17, wherein the ignition control system further comprises:

memory, storing an algorithm or a lookup table, coupled to a processor of the controller, the processor of the controller configured to calculate a time delay for outputting the activation signal based on the sensed magnitudes of the first and second metrics, and the algorithm or a lookup table.

21. The artillery round of claim 20, wherein the second sensor is configured to detect spin rate of the projectile body.

22. The artillery round of claim 20, wherein the second sensor is configured to detect gun barrel pressure.

* * * * *